US006659155B1

(12) United States Patent
Mlenek et al.

(10) Patent No.: US 6,659,155 B1
(45) Date of Patent: Dec. 9, 2003

(54) BIDIRECTIONAL SWINGING SCREEN DOOR AND FRAME ASSEMBLY

(75) Inventors: Michael A. Mlenek, Folsom, CA (US); Patrick L. Mlenek, Folsom, CA (US); Duane C. Balch, Tracy, CA (US); Denis R. Niemeyer, Granite Bay, CA (US)

(73) Assignee: Freedom Door Company, Inc., Reno, NV (US)

( * ) Notice: Subject to any disclaimer, the term of this patent is extended or adjusted under 35 U.S.C. 154(b) by 0 days.

(21) Appl. No.: 10/118,520

(22) Filed: Apr. 5, 2002

(51) Int. Cl.[7] ..... E06B 9/01
(52) U.S. Cl. ..... 160/117; 160/369; 49/236
(58) Field of Search ..... 160/117, 369, 160/210, 211, 90, 113, 371; 49/236, 237, 239; 16/309, 312, 317, 318

(56) References Cited

U.S. PATENT DOCUMENTS 830,022 A * 9/1906 Stiles ..... 49/236
1,430,015 A * 9/1922 Icher ..... 160/117
3,510,986 A * 5/1970 Berkowitz ..... 49/236
3,628,845 A * 12/1971 Grimm ..... 16/309
3,648,327 A * 3/1972 Edeus ..... 16/309
4,090,274 A * 5/1978 Bourgeois ..... 16/309
4,838,332 A 6/1989 Mlenek
5,133,152 A * 7/1992 Grancagnolo ..... 49/239
5,265,311 A * 11/1993 Gard ..... 16/318
5,417,272 A * 5/1995 Marlowe et al. ..... 160/211 X
5,908,064 A * 6/1999 Bruce ..... 160/211 X

* cited by examiner

*Primary Examiner*—David Purol
(74) *Attorney, Agent, or Firm*—Heisler & Associates

(57) ABSTRACT

A swinging screen door and associated frame are provided for coupling to a doorway of a structure such as a house. Hinges are provided which pivotably connect the doors to the frame in a fashion allowing the doors to pivot inward through the doorway and outward away from the doorway. The hinge includes a knuckle joint between the frame and a bottom of each door. A knuckle and recess of the knuckle joint are provided with a complemental form to cause the knuckle joint to bias the door toward a closed position. A ramp and wing combination in the knuckle joint cause the door to be elevated when moved away from the closed position so that the door can more easily clear obstacles on the floor adjacent the doorway. A recoil joint axially aligned with the knuckle joint holds a top of the door relative to the frame.

35 Claims, 5 Drawing Sheets

BIDIRECTIONAL SWINGING SCREEN DOOR AND FRAME ASSEMBLY

FIELD OF THE INVENTION

The present invention relates to doors for patio doorways and particularly pertains to a bidirectional swinging screen door and frame assembly.

BACKGROUND OF THE INVENTION

Patio doorways are often configured with a sliding glass door arrangement. Such doorways are typically framed with tracks for sliding one or more doors open and closed. Within this patio doorway frame a seasonal sliding screen door can be arranged parallel to the sliding glass door. By sliding the glass door along the track to its open position and having it remain in the open position, the screen door can then function as the primary means for exiting and entering through the patio doorway. The sliding screen door maintains a barrier between the outdoors and inside of the home while providing for increased fresh air and sensory perception of the recreation in the backyard or patio.

Improvements in screen door arrangements provide a more versatile and aesthetically pleasing entryway. Many of these improvements are described in U.S. Pat. No. 4,838,332 to Mlenek. The assembly includes a replacement screen door surrounded by a frame which connects to the patio doorway of the house. Once mounted to the patio doorway of the house, the screen door is hinged within the frame, allowing the door to be opened in either an inwardly or outwardly direction. In addition, the assembly has a mechanism for returning the door to the closed position.

While this prior art assembly is generally effective, it lacks many desirable functional attributes. First, the frame of the assembly only borders three sides of the opening, making alignment of the two screen doors difficult. Second, the doors lack the ability to be detained in the open position. Third, the doors lack the ability to be elevated when opened to clear rugs or other structures on the floor adjacent the doors. Still other aspects of this prior art assembly make it less than optimal and amenable to improvement.

SUMMARY OF THE INVENTION

The present invention provides a bidirectional swinging door assembly for mounting in a patio doorway. The assembly of this invention includes a frame attachable to the patio doorway and at least one door, such as a screen door, pivotably mounted to the frame.

The frame is configured so that it entirely surrounds an opening in the patio doorway. Preferably, two doors are pivotably attached to the frame in a manner allowing each door to swing both inward and outward relative to the doorway. A user can thus easily pass through the doorway in either direction by merely pushing the doors in a swinging fashion from a closed position occluding the opening to an open position allowing the user to pass through.

At least one hinge supports each door in a pivoting fashion relative to the frame. The hinge is configured to allow each door to swing both inward and outward. Each door includes a means to bias the door toward a closed position. Preferably, this biasing means is in the form of a sloped ramp coupled to the frame beneath the door and a wing on the door located such that the wing rides up the slope when the door is moved from the closed position to the open position. Gravitational forces thus bias the door towards the closed position. Preferably, a means is provided to detain the door in an at least partially open position so that the door can remain open when in this detained position. Preferably, this detaining means is in the form of a notch in the wing and a crest at a top of the slope so that when the notch in the wing aligns with the crest of the slope, the door is held stationary in this at least partially open position.

Preferably, the hinge includes an upper portion and a lower portion each coaxially aligned with a common pivoting axis. The upper portion of the hinge pivotably couples a top portion of the door to a top portion of the frame. A lower portion of the hinge couples a lower portion of the door to a lower portion of the frame.

In addition to the slope and wing or other means to bias the door toward the closed position, the slope and wing configuration additionally provides a preferred form of a means to elevate the door when the door is opened away from the closed position. As the wing rides up the slope, the door is elevated, allowing a lower portion of the door to more easily clear obstacles resting upon the ground adjacent the doorway and inside or outside of the structure in which the doorway is located.

OBJECTS OF THE INVENTION

Accordingly, a primary object of the present invention is to provide a screen door that opens in either direction; i.e., the screen door swings inwards as well as outwards.

Another object of the present invention is to provide a bidirectional swinging screen door with a door stop for detaining the door in open positions.

Another object of the invention is to provide a screen door in which a person may choose between pushing or pulling the door open when both entering and exiting through the doorway.

Another object of the invention is to provide a bidirectional swinging screen door that opens without excessive force allowing a person to pass through whose hands are not free or who may be using a wheelchair or other means of mobility that require the use of the hands.

Another object of the invention is to provide a bidirectional swinging screen door that is both lightweight and sturdy.

Another object of the invention is to provide a bidirectional swinging screen door that, when opening in either direction, elevates above the threshold to achieve suitable clearance of carpet, rugs, mats, or other common structures within the entryway.

Another object of the invention is to provide a screen door which returns to the closed position after it has been opened in either direction.

Another object of the invention is to provide a screen door that maintains a weatherproof seal.

Another object of the invention is to provide a screen door frame assembly which may be adjusted to fit in commercially available patio doorways.

Another object of the invention is to provide a screen door which can be easily installed adjacent a doorway opening with the doors having precise proper alignment.

Other further objects of the present invention will become apparent from a careful reading of the included drawing figures, the claims and detailed description.

DESCRIPTION OF THE PREFERRED EMBODIMENT

Figure 2:
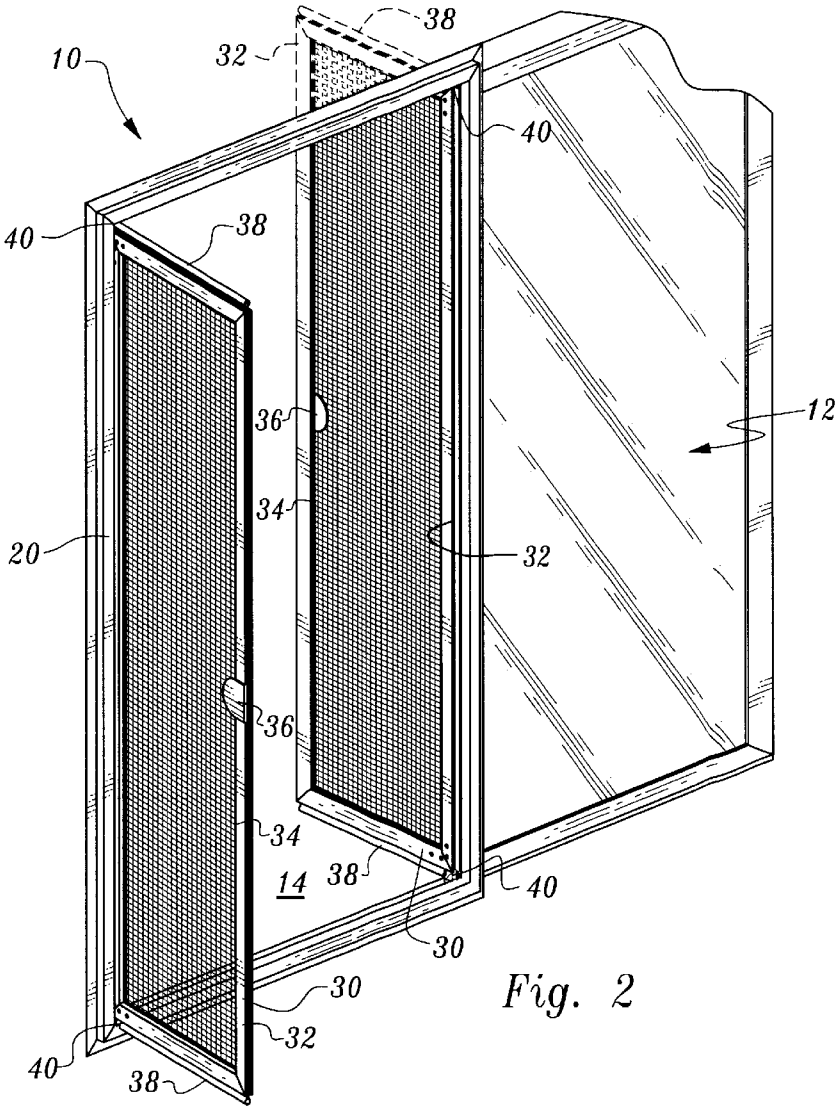
FIG. 2 is a perspective view of the installed screen door having the two screen panels detained in diametrically opposed open positions.

Referring to the drawings, wherein like reference numerals represent like parts throughout the various drawing figures, reference numeral 10 is directed to a bidirectional swinging screen door assembly for a patio doorway 12. The door assembly 10 is configured to be installed adjacent the doorway 12 so that the doors 30 can pivot both in and out through an opening 14 in the doorway 12.

In essence, and with particular reference to FIGS. 1–5, the basic details of the screen door assembly 10 of the preferred embodiment are described. The screen door assembly 10 includes an assembly frame 20 sized to substantially completely surround the opening 14 in the patio doorway 12. The frame 20 is preferably affixed to the doorway 12 so that the frame 20 remains stationary relative to the doorway 12. For clarity, the frame 20 can be referred to as the secondary frame 20, with the screen door 30 having a screen frame 32 about a perimeter thereof that acts as a primary frame 32. At least one and preferably two screen doors 30 are pivotably attached to the frame 20 through a hinge 40. The hinge 40 allows each door 30 to pivot both inward through the doorway 12 and outward away from the doorway 12.

Preferably, the hinge 40 is in the form of a two-point hinge 40 including a lower portion pivotably connecting a bottom portion of the adjacent door 30 to a lower portion of the frame 20. The two-point hinge 40 additionally includes an upper portion pivotably connecting a top portion of the adjacent door 30 to an upper portion of the frame 20. Preferably, the upper portion and lower portion of the hinge 40 are aligned with a common substantially vertically oriented pivoting axis for each door 30.

Figure 3:
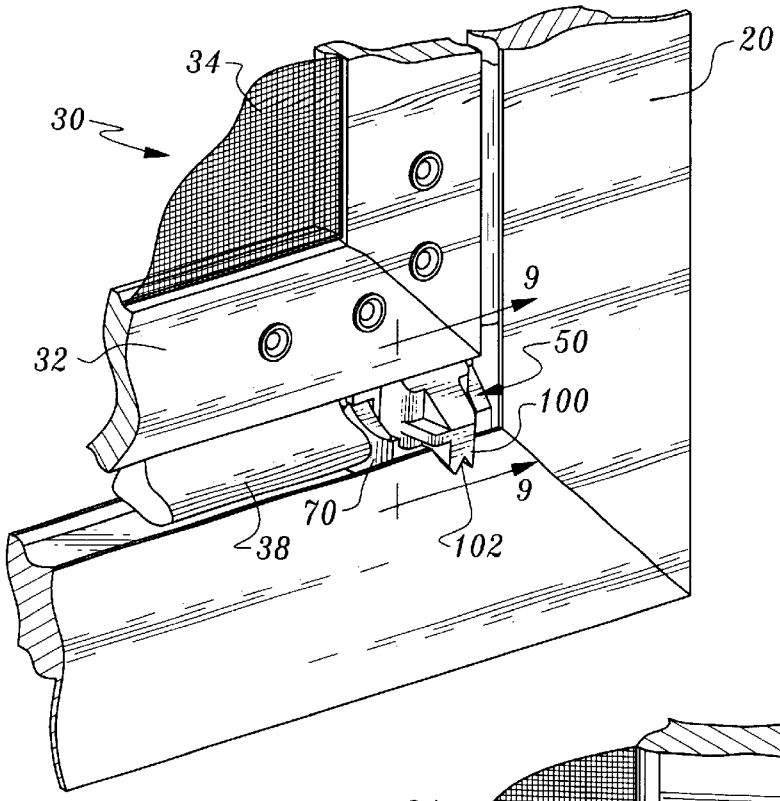
FIG. 3 is a perspective view of the lower corner of the screen door and frame in the closed position, showing the bottom portion of the two-point connection hinge and knuckle joint.
Figure 4:
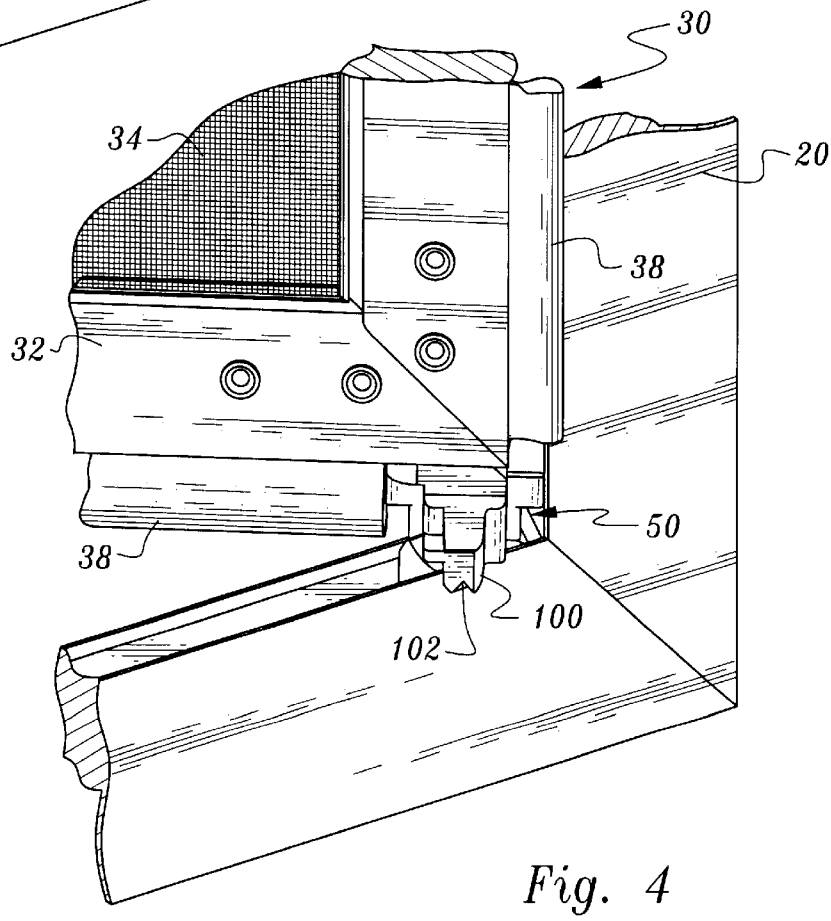
FIG. 4 is a perspective view of the same lower corner of the door and frame shown in FIG. 3 with the knuckle joint shown with the door in a partially open position.
Figure 5:
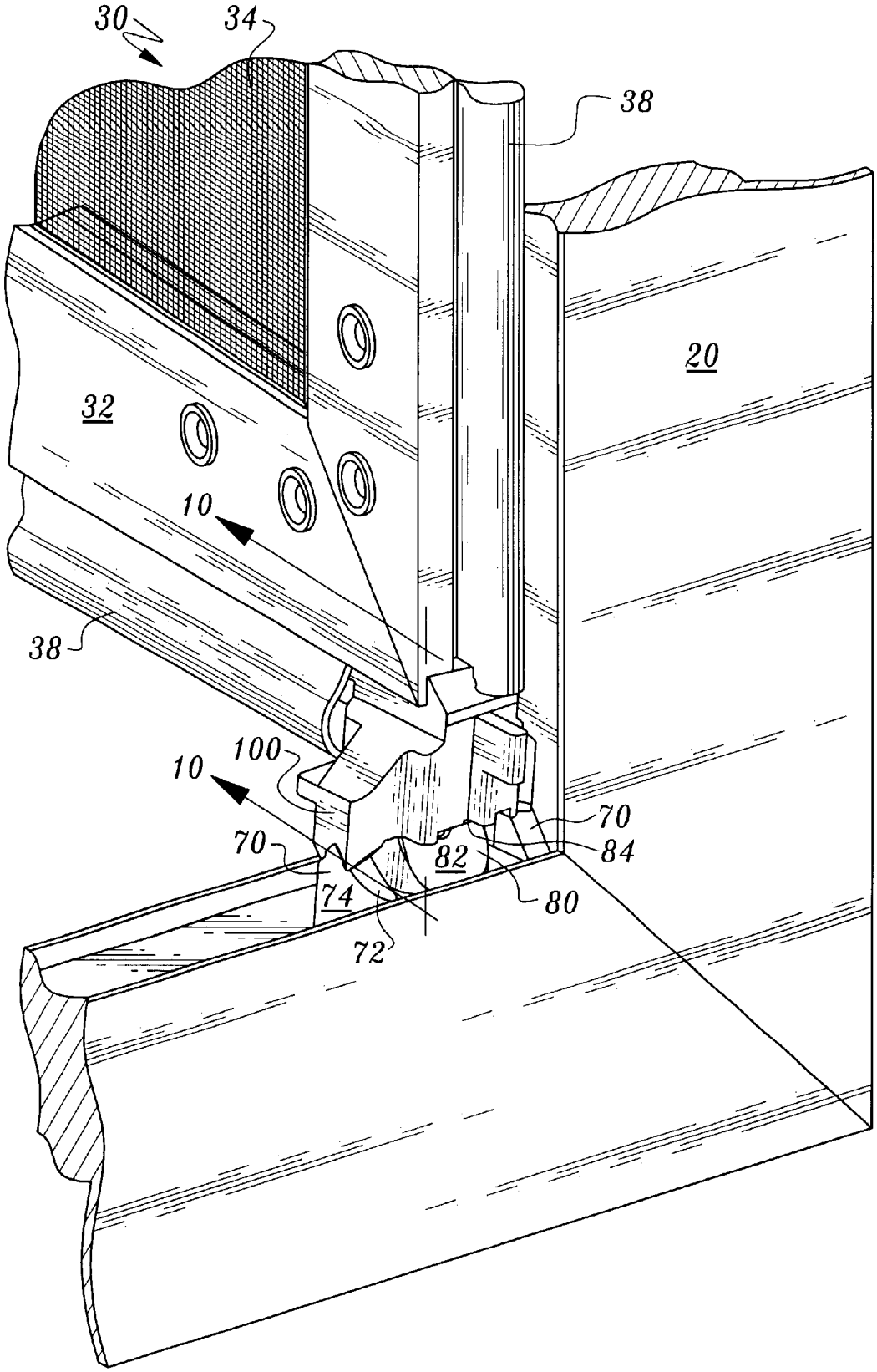
FIG. 5 is a perspective view of the same lower corner of the door and frame shown in FIGS. 3 and 4 with the knuckle joint in operation as the door is detained in the open position.

A knuckle joint 50 is provided adjacent the lower portion of the two-point hinge 40 (FIGS. 3–5). Each knuckle joint 50 includes a knuckle 80, ramps 70, wings 100 and a recess 110 which together provide a bias encouraging the adjacent door 30 toward a closed position. Specifically, the wings 100 are oriented so that they ride up a ramp 70 as the door 30 is opened away from the closed position. Gravitational forces acting on the door tend to cause the door to rotate back to the closed position as the wings 100 slide back down the ramps 70. A knuckle 80 and recess 110 have matching surfaces when the adjacent door 30 is in the closed position. The knuckle 80 and recess 110 thus help hold the adjacent door 30 in the closed position unless forces are applied to the door 30 to open the door 30, such as by a user pushing on the door 30. The various structures of the knuckle joint 50 additionally provide a means to elevate the door 30 when the door 30 in opened away from the closed position.

The upper portion of the hinge 40 is configured as a recoil joint 140. The recoil joint 140 includes a top pin 160 to keep the upper portion of the hinge 40 aligned with the pivoting axis. A compression spring 200 gets compressed when the adjacent door 30 is elevated relative to the frame 20. The compression spring 200 thus works in conjunction with gravity to increase downward forces on the adjacent door 30 when the door 30 is pivoted away from the closed position and elevated by the wings 100 riding up the ramps 70. The compression spring 200 thus assists in encouraging the adjacent door 30 back to the closed position. Notches 102 in the wings 100 can straddle crests 76 of the ramps 70 so that the door 30 remains detained when rotated to this stop position, preferably corresponding with a fully open position for the door 30. The doors 30 can thus be held open automatically when desired.

Figure 1:
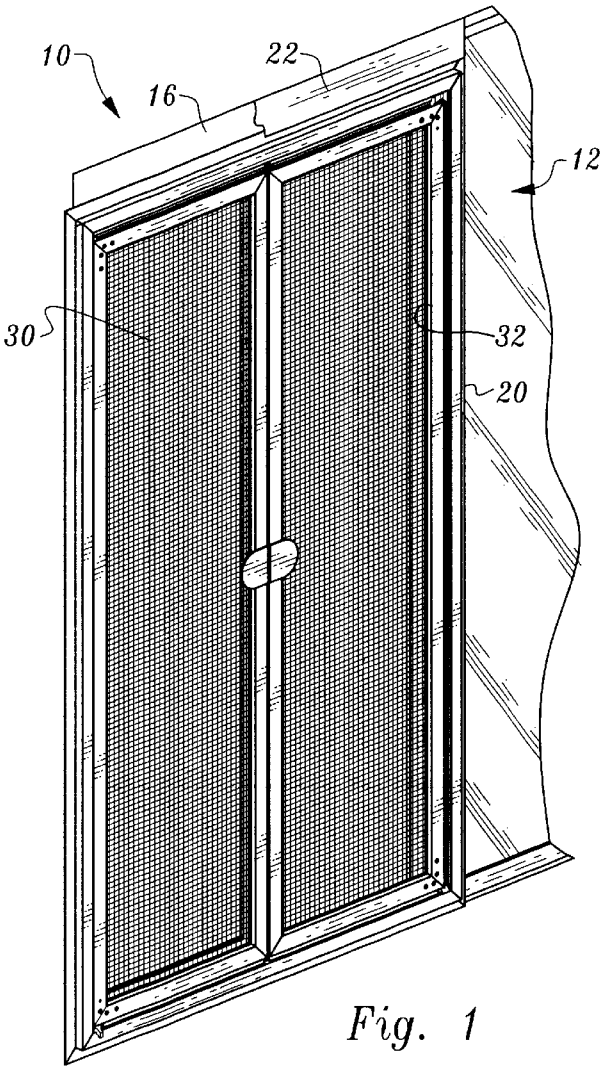
FIG. 1 is a perspective view of the screen door assembly of the present invention installed in a patio doorway. The embodiment shown comprises a screen door having two separately hinged screen panels in which one panel may be opened mutually exclusive of the other.

More particularly, and with particular reference to FIGS. 1 and 2, details of the frame 20 are described. The door assembly 10 is mounted to the structure (i.e. a house) adjacent the patio doorway 12. The patio doorway 12 of the structure typically has one or more patio doors that are mounted in parallel planes either fixed or on tracks within the patio doorway 12. At least one of the patio doors slides along the tracks so that when it is retracted a portion of the patio doorway 12 forms an opening 14. Typically, the patio doors are solid and have glass or screen paneling.

The frame 20 of the assembly 10 preferably includes four sides, including an upper portion, a lower portion and two side portions each extending from the upper portion to the lower portion, and dimensioned to allow the frame 20 to be attached to the structure adjacent the patio doorway 12, typically on an exterior of the structure. The frame 20 is made of a substantially rigid material, such as that used for the patio doorway 12 frame, such as aluminum or similar material. The rigidity of the frame 20 allows the frame 20 to be positioned adjacent the patio doorway 12, either free standing or affixed to the patio doorway 12 jambs or adjacent portions of the structure. The frame 20 is adaptable to fit the openings of most patio doorways provided the opening is sufficiently large to receive all four sides of the frame 20.

Trim 22 is provided with the door assembly 10 to fill in any gaps 16 left between the top of the frame 20 and the patio doorway 12 with large vertical dimensions. For example, FIG. 1 shows a patio doorway 12 with a large vertical dimension and the trim 22 is mounted between the frame 20 and the patio doorway 12 to provide a seal where the frame 20 does not cover the opening through the doorway 12. The trim 22 is made of weatherstripping material or the like that can preferably be cut to size.

With continuing reference to FIGS. 1 and 2, details of the screen doors 30 are described. Each screen door 30 includes a screen frame 32 surrounding and supporting one or more screen panels 34. A suitable screen panel 34 is mounted within the screen frame 32 with the screen frame 32 forming the edges of the screen door 30. The screen door 30 further includes a handle 36 and weatherstripping 38. The weatherstripping 38 can be attached to all four sides of the screen door 30 and provides a weatherproof seal.

Each door assembly 10 further includes a two-point hinge 40. The two-point hinge 40 provides an axis for pivoting of the screen door 30 and pivotably connects the screen door 30 to the frame 20 at a top of the screen door 30 and a bottom of the screen door 30. The two-point hinge 40 has two axially aligned portions, including an upper hinge portion and a lower hinge portion, that work together to pivotably support the door 30 relative to the frame 20 and provide the door 30 with a bias towards a closed position, provide bidirectional swing of the doors into and out of the structure and provide a means to detain the doors 30 on a stop position. The upper hinge portion or recoil joint 140 is mounted between the top portion of the screen door 30 and the frame 20. The lower hinge portion or knuckle joint 50 is positioned between the bottom portion of the screen door 30 and the frame 20.

FIG. 2 shows the placement of each two-point hinge 40 for an embodiment that divides the screen door 30 vertically into separately openable and independently hinged doors 30. The doors 30 include a portion of a hinge 40 mounted between the screen frame 32 of each door 30 and the secondary frame 20, adjacent the four corners of the secondary frame 20. In FIG. 2, a left door 30 is shown opening outwardly, while a right door 30 is shown opening inwardly. Alternatively, one door 30 rather than two can be used. When only one door 30 is used, only one two-point hinge 40 is needed. The one two-point hinge 40 for such a single door can be placed on either side of the door between the top and bottom of the screen frame 32 and secondary frame 20.

Figure 6:
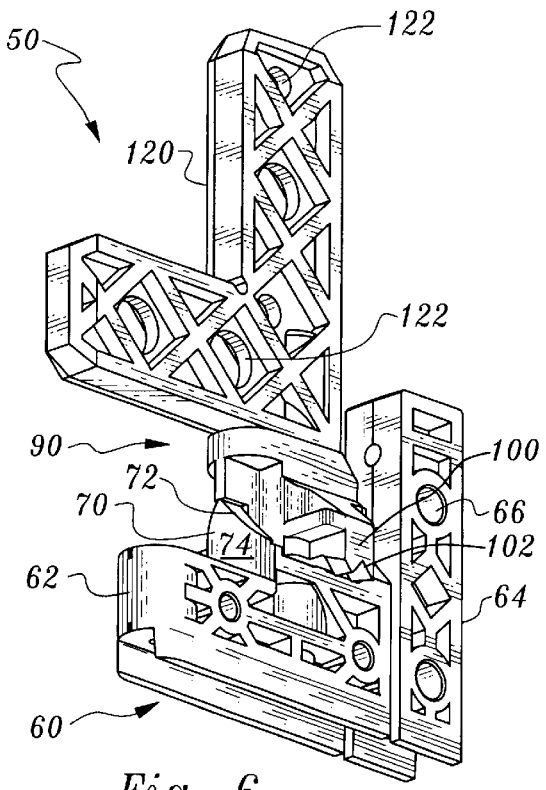
FIG. 6 is a perspective view of the bottom portion of the two-point connection hinge or knuckle joint appears unmounted in the door and frame.
Figure 8:
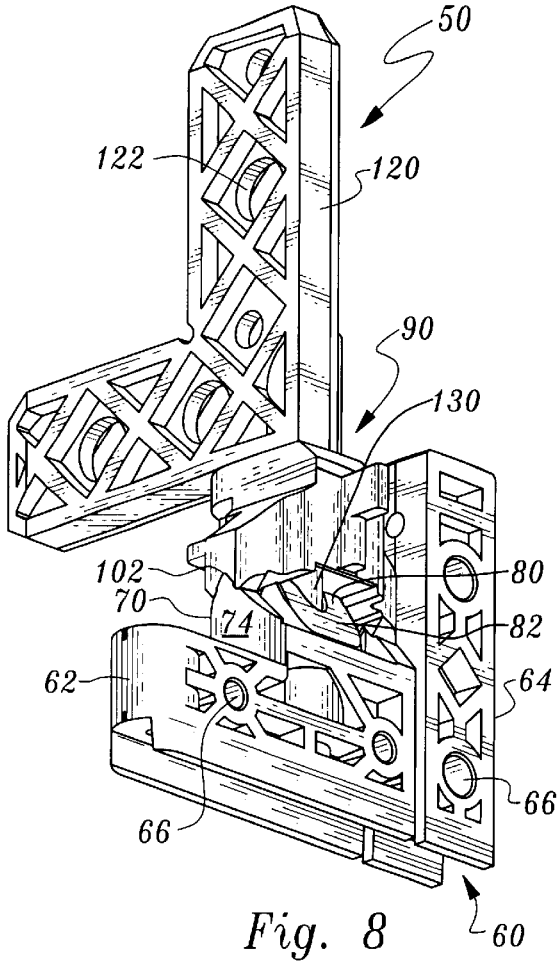
FIG. 8 is a perspective view of the same knuckle joint shown in FIGS. 6 and 7 as it would appear with the door detained in the open position.
Figure 7:
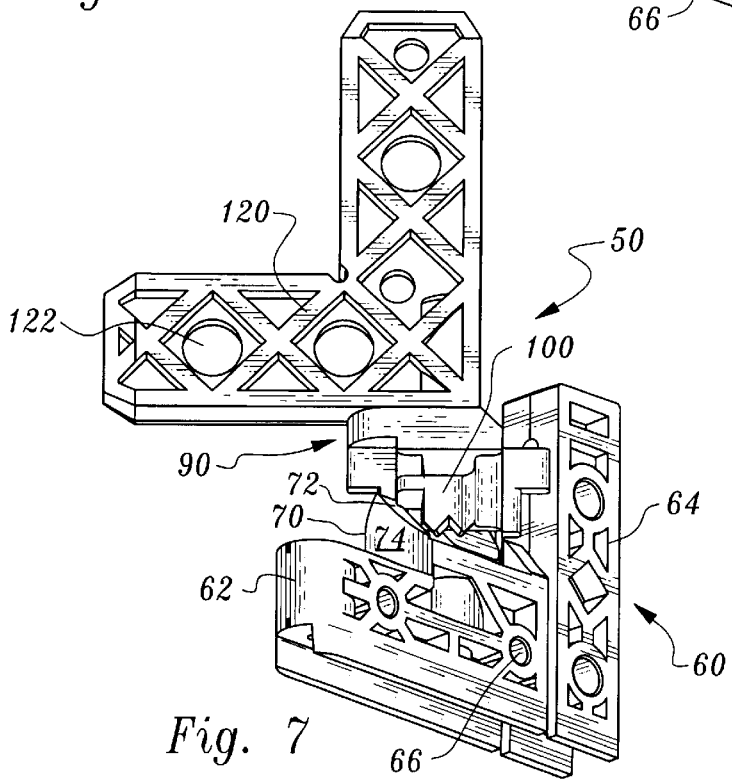
FIG. 7 is a perspective view of the same knuckle joint shown in FIG. 6 as it would appear in operation with the door in a partially open position.
Figure 9:
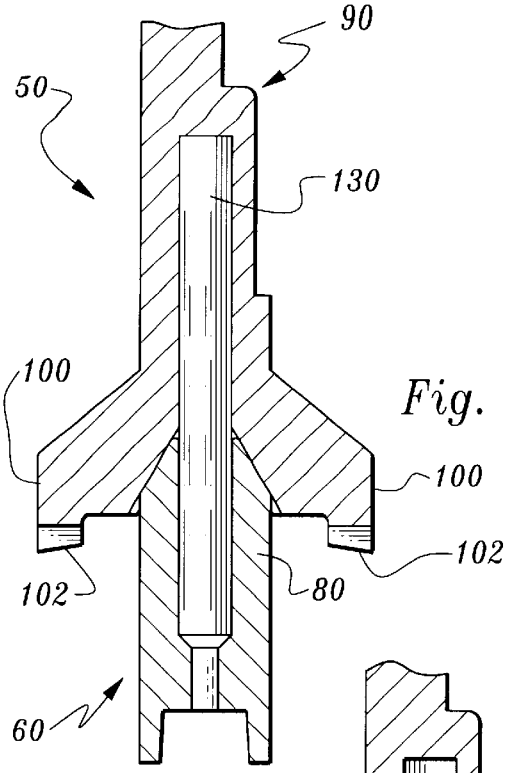
FIG. 9 is a full-sectional view of the knuckle joint taken along line 9—9 of FIG. 3, showing the knuckle joint with the door in the closed position.
Figure 10:
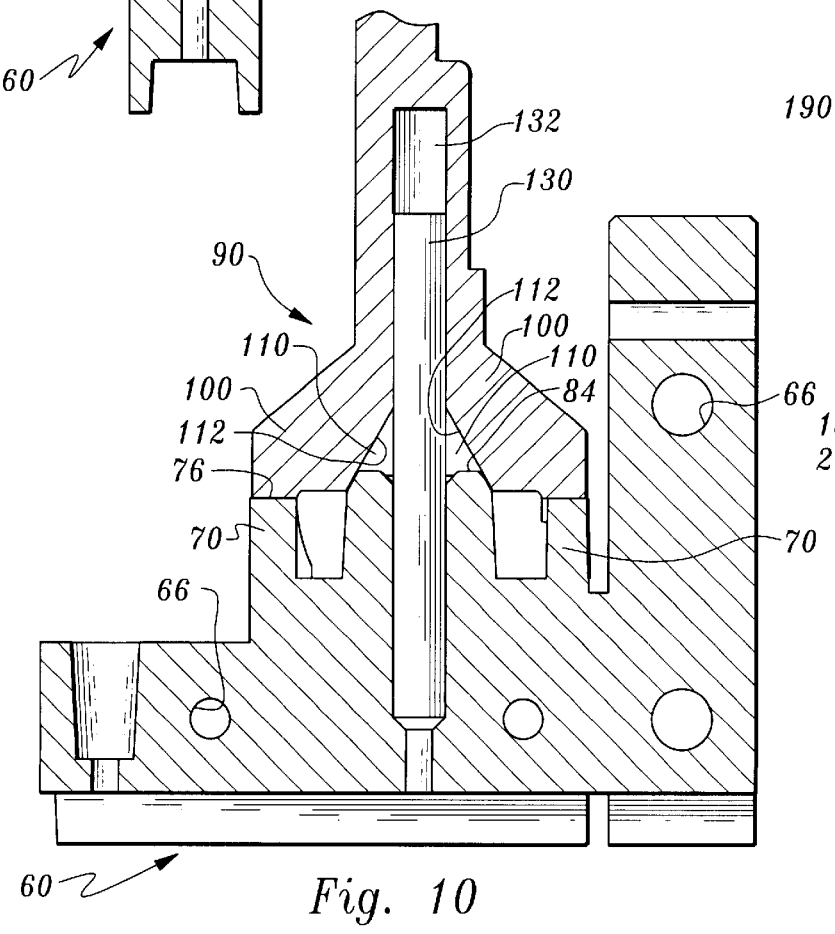
FIG. 10 is a full-sectional view taken along line 10—10 of FIG. 5, showing the knuckle joint with door detained in the open position.

The two-point hinge 40 includes a knuckle joint 50 forming the lower hinge portion and a recoil joint 140 forming the upper hinge portion. FIGS. 3, 4 and 5 show the knuckle joint 50 mounted between the screen door 30 and frame 20. FIGS. 6, 7 and 8 show the knuckle joint 50 free from the framings and mountings of the door assembly 10 and match the perspectives of the screen door 30 in pivoting motion represented in FIGS. 3, 4 and 5 respectively. FIGS. 9 and 10 show full sectional views of the knuckle joint 50.

The knuckle joint 50 is made up of two adjacent cooperating members: a stationary member affixed to the frame 20, identified as the knuckle base 60 and a pivoting member affixed to the screen door 30 and identified as the heel assembly 90. The knuckle base 60 extends up from the frame 20 and provides stationary surfaces for adjacent surfaces of the heel assembly 90 to pivot upon. The heel assembly 90 extends down from the screen door 30 and provides pivoting surfaces that ride on the adjacent surfaces of the knuckle base 60.

The knuckle base 60 is generally L-shaped (when oriented to support the left door 30) or reverse L-shaped (for the right door 30). A horizontal member 62 and vertical member 64 form the L-shape of the knuckle base 50. These legs 62 and 64 reside within a hollow interior of the frame 20 at a lower corner. Other shapes suitable for corner-frame mounting may be used to form the knuckle base 60, as well. Mounting holes 66 are provided for receiving a fastener, such as a screw or rivet to facilitate the fastening of the knuckle base 60 to the frame 20. The knuckle base 60 is preferably made of an injection moldable material to facilitate formation of the various surfaces of the base 60. The legs 62 and 64 of the knuckle base 60 have a lattice pattern to minimize material and weight, without compromising strength.

A knuckle 80 extends up from the horizontal member 62 of the L-shaped knuckle base 60. The knuckle 80 has a hollow center for receiving the knuckle pin 130. The knuckle pin 130 extends vertically along the pivoting axis of the door 30. The pin 130 keeps the door 30 aligned with the frame 20 as the door 30 pivots. The pin 130 allows the door 30 to translate vertically somewhat during installation of the door 30 into the frame 20 and during pivoting of the door 30.

The knuckle 80 preferably has a non-circular cross section with two diagonal slopes 82 tapering up to a ridge 84. The ridge 84 extends horizontally with the pin 130 extending up from the hollow center in a middle of the ridge 84. The slopes 82 cooperate with a recess 110 in the heel assembly 90 of the door 30, as described in detail below.

The knuckle 80 is preferably flanked by two ramps 70. Each ramp 70 includes a pair of tapered slopes 72 tapering up to a crest 76. The slopes 72 are preferably somewhat arcuate about a center of curvature at the pivoting axis for the door 30. The ramps 70 cooperate with the wings 100 described in detail below.

The knuckle joint 50 further includes a heel assembly 90. A foot 120 includes the heel assembly 90 thereon and is provided with mounting holes 122 for mounting of the heel assembly 90 to the screen door 30. The foot 120 is analogous to the horizontal member 62 and vertical member 64 of the knuckle base 60 and is lattice patterned, as well.

The heel assembly 90 includes a recess 110 open in a downwardly facing direction. The recess 110 is non-circular in cross-section and preferably has a contour that is complemental with the contour of the knuckle 80. The knuckle 80 can thus extend up into the recess 110. The recess 110 includes diagonal surfaces 112 that are adjacent the diagonal slopes 82 of the knuckle 80 when the recess 110 is aligned with the knuckle 80. When the door 30 is pivoted, the recess 110 and knuckle 80 come out of alignment and the recess 110 is caused to ride up on the knuckle 80, thus providing one means to elevate the door 30.

The recess 110 is flanked by two wings 100. The wings 100 extend out from the recess 110 a distance similar to a distance the ramps 70 extend out from the knuckle pin 130. The wings 100 have a proper height to abut the ramps as the recess 100 abuts the knuckle 80. As the door 30 is pivoted, the wings 100 ride up the slopes 72 of the ramps 70. Because each of the two ramps 70 includes two slopes 72, wings 100 ride up slopes 72 of separate ramps 70 when the door is pivoted in either direction.

When the door 30 is pivoted to a fully open position, the wings 100 have notches 102 which straddle the crest 76 of each ramp 70. At this location, the door 30 is held open. Otherwise, gravitational forces on the door 30 cause the wings 100 to slide down the slopes 72 and return the door 30 to the closed position.

Figure 11:
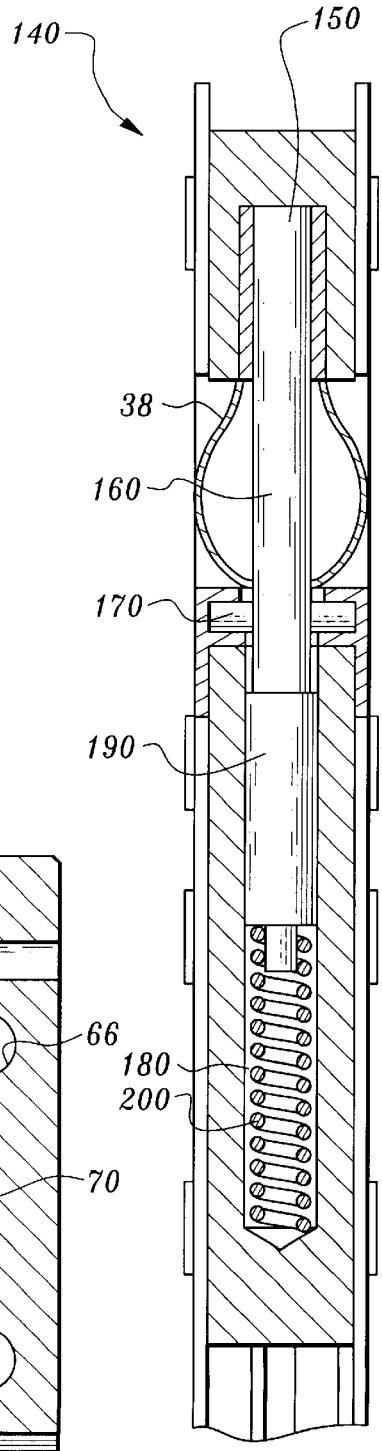
FIG. 11 is a full-sectional view of the top portion of the two-point connection hinge and recoil joint.

The upper hinge portion or recoil joint 140 of the two-point hinge 40 is shown in FIG. 11. The recoil joint 140 includes a frame cavity 150 located within the frame 20. The frame cavity 150 holds a top pin 160 which connects to the screen door 30 section of the recoil joint 140. Within the screen door 30 section, the recoil joint 140 further includes a collar 170 for stabilizing the top pin 160 in its connection between the frame 20 and screen door 30. In addition, the screen door 30 has a vertically extending hollow bore providing a housing 180 for a plunger 190. The housing 180 holds the plunger 190 and a compression spring 200 beneath the plunger 190. The top pin 160 is preferably connected to the plunger 190. The collar 170 keeps the plunger 190 and pin 160, as well as the spring 200 trapped within the housing 180.

When the door 30 is installed, the pin 160 is fed up into the cavity 150. The spring 200 is compressed by further elevating the door 30 until the recess 110 of the heel assembly 90 and the knuckle pin bore 132 can be placed over the knuckle pin 130. The door is then in place for pivoting. Alternatively, the pin 130 can be fixed within the bore 132 and the pin 130 fed into the hollow center in the ridge 84 of the knuckle 80.

In use and operation, and with particular reference to FIGS. 1 and 2, details of the operation of the screen door assembly 10 of this invention are described. Initially, the user selects the doorway 12 that is to be fitted with the screen door assembly 10 of this invention. Typically, such an appropriate doorway 12 would be a sliding glass door opening 14. Alternatively, the screen door assembly 10 could be fitted adjacent French doors or other appropriate doorways of a structure. While the assembly 10 of this invention includes screen doors 30 in the preferred embodiment, it is not strictly required that only screen doors 30 be included in this assembly 10. Rather, other types of doors including transparent doors of glass or other materials, or solid non-transparent doors could be similarly provided as part of the assembly 10 of this invention.

Before mounting the assembly 10, the existing sliding screen door of the sliding glass doorway would typically be removed (but could optionally be left in place slid to an open position). The frame 20 of the assembly 10 is then affixed to the doorway 12 surrounding the opening 14 and preferably on an exterior of the structure in which the doorway 12 is formed. The lower portion of the frame 20 is preferably adjacent a bottom of the doorway 12 so that the lower portion of the frame 20 does not present a tripping hazard for people walking out through the doorway 12 and over the lower portion of the frame 20.

The side portions of the frame 20 are preferably adjacent sides of the doorway 12. Preferably, the side portions of the frame 20 extend slightly into the opening 14 of the doorway 12 so that the doors 30 can pivot both inward through the opening 14 and into the structure in which the doorway 12 is located as well as outward away from the opening 14 in the doorway 12. Preferably, the width of the frame 20 is slightly less than a width of the opening 14 to provide the doors 30 with clearance as discussed above. While the frame 20 is shown with a fixed width, the frame can be configured to be width adjustable if needed to accommodate openings 14 of different widths. The frame 20 can be affixed to the structure adjacent the doorway 12 using appropriate fasteners, such as screws to affix the frame 20 to the doorway 12 surrounding the opening 14. Alternatively, an adhesive could be utilized to bond the frame 20 to the doorway 12. Preferably, the frame 20 has its upper portion spaced above the lower portion with a fixed height. To accommodate doorways 12 of different heights, a piece of trim 22 is provided. This trim 22 is affixed to the doorway 12 to fill a gap 16 between the upper portion of the frame 20 and a top of the doorway 12. The trim 22 is preferably formed of a material which can easily be cut to size so that doorways 12 of different heights can be accommodated.

Once the frame 20 and trim 22 have been affixed to the doorway 12, the doors 30 are ready to be installed into the frame 20. Because the frame 20 completely surrounds the opening 14, various different portions of the frame 20 do not require alignment together for proper alignment and operation of the doors 30. Preferably, the assembly 10 includes two doors 30 which each fill half of the opening 14 within the frame 20. As discussed above, the doors 30 have their pins 130, 160 (FIGS. 10 and 11) aligned with associated recesses in the frame 20 with the spring 200 compressed initially to allow both pins 130, 160 to enter the appropriate recesses in the frame 20. The spring 200 then causes the pins 130, 160 to extend into the adjacent recesses and the door 30 is held within the frame 20. Once in position, the doors 30 can pivot about two parallel pivoting axes but are prevented from any other rotation or translation, other than slight vertical translation when the spring 200 is compressed.

With particular reference to FIGS. 3–10, details of the pivoting operation of the doors 30 are described. The knuckle joint 50, including the knuckle base 60 and the heel assembly 90, provides many of the pivoting functional details of the assembly 10 of this invention. The recess 110 of the heel assembly 90 and knuckle 80 of the knuckle base 60 are configured to have their contours complementally mate together with the knuckle 80 extending up into the recess 110 when the door 30 is in a closed position. Preferably, this closed position is a position in which the door 30 occludes a maximum amount of the opening 14. However, it is only strictly necessary that this closed position be a position in which the opening 14 is more occluded than a second open position. Most preferably, the open position of the door 30 is a position where the door. 30 is pivoted 90° away from the frame 20 and leaves the opening 14 totally open. However, it is only strictly necessary that the open position provide less occlusion of the opening 14 in the frame 20 than the closed position.

The compression spring 200 provides a force downward on the door 30. Gravitational forces also act downward on the door 30. Hence, the door 30 remains in a lowermost position with the recess 110 aligned with the knuckle 80, so that the door 30 is biased towards the closed position. While this bias is preferably in the form of the recess 110 and knuckle 80, other forms of bias structure could be provided to apply forces tending to return the door 30 to the closed position. While it is not strictly necessary to include the compression spring 200 to enhance the force with which the door 30 is biased toward the closed position, inclusion of such a spring 200 is preferred.

The recess 110 and knuckle 80 do not prevent the door 30 from rotating. When forces are applied to the door 30 tending to cause the door 30 to pivot about the pivoting axis, the knuckle pin 130 keeps the recess 110 aligned with the knuckle 80 and the heel assembly 90 of the door 30 rotates relative to the knuckle base 60. Because the recess 110 and knuckle 80 do not have circular cross-sections, but rather include diagonal slopes 82 and diagonal surfaces 112, the heel assembly 90 and associated door 30 translate vertically upward as the door 30 rotates. When opening forces applied to the door 30 are removed, gravity and compression spring 200 forces act on the door 30 to cause the recess 110 to slide back down onto the knuckle 80 and be recentered in the closed position for the door 30.

When the door 30 is pivoted to the open position, the recess 110 rides up entirely off of the knuckle 80. In this position, the diagonal surfaces 112 of the recess 110 are away from the diagonal slopes 82 of the knuckle 80. Downward forces acting on the door 80 are held between the recess and the knuckle 80 on a ridge 84 of the knuckle 80 and no pivoting return forces are exerted on the door 30. Thus, the door 30 tends to remain in the open position. This detained or stop position of the door 30 conveniently allows the door 30 to remain open when desired in a fully open position. A user can cause the door 30 to return to a closed position by merely applying a slight force towards closing the door 30. The diagonal surfaces 112 of the recess 110 and diagonal slopes 82 of the knuckle 80 then act together to encourage the door 30 to rotate back to the closed position. The knuckle 80 and recess 110 thus provide one means to both detain the door 30 when in an open position and to return the door 30 to the closed position when moved out of the detained position.

In addition to the knuckle 80 and recess 110, the knuckle base 60 and heel assembly 90 preferably additionally include the ramp 70 and wing 100 combination described in detail above. When the door 30 is rotated away from the closed position in either direction, the wings 100 ride up the ramps 70. The wings 100 and ramps 70 thus coact to encourage the door 30 to be biased towards the closed position. When the wings 100 ride all of the way up to the crest 76 of the ramps 70, the notches 102 and the wings 100 straddle the crest 76 of each ramp 70. This straddling action causes the doors 30 to relatively easily hold the detained open position with the bias toward the closed position neutralized. However, slight closing forces on the doors 30, such as applied by hands of a user, will cause the doors 30 to return to the closed position.

The wings 100 and ramps 70 act together to elevate the door 30 as do the recess 110 and knuckle 180. While preferably both of these combined structures are provided, it is conceivable that either one of these assemblies could be utilized alone to provide the closing function and elevating function for the door 30. When the door 30 is moved away from the closed position, the door 30 is elevated by the knuckle 80 and recess 110 interaction and by the wing 100 and ramp 70 interaction. This elevating of the door 30 serendipitously not only assists in biasing the door 30 towards the closed position by compressing the spring 200 and increasing gravitational potential energy, but also increases a clearance experienced by a bottom portion of the door 30 over structures directly inside the doorway 12 or outside the doorway 12. For instance, if carpeting and/or rugs inside the structure and adjacent the doorway 12 extend slightly above a level of the bottom of the doorway 12 and the frame 20, the bottom of the door 30 is provided with clearance to avoid these structures when the door 30 is opened. The doors 30 thus conveniently can open and close in both an inward and an outward fashion relative to the doorway 12 with maximum clearance to avoid obstacles and still provide a tight seal when closed to prevent migration of bugs past the door 30.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Unless specifically limited, such coupling could be permanent or temporary and either in a rigid fashion or in a fashion which allows pivoting, sliding or other relative motion while still providing some form of attachment.

What is claimed is:

1. A pivoting screen door receivable within a patio doorway, the door selectively occluding an opening formed by retracting a sliding patio door within the patio doorway, the pivoting screen door comprising in combination:

a screen frame;

a screen panel at least partially bordered by said screen frame;

at least one hinge coupled to said screen frame and said patio doorway;

said door including a bias tending to locate said door in a closed position spaced from an open position, said closed position at least partially occluding the opening, said closed position occluding a greater portion of the opening than said open position;

said door having a door stop position at least as close to said open position as to said closed position;

said bias sufficiently neutralized when said door is located at said door stop position to allow said door to remain detained in said door stop position; and said hinge oriented adjacent a pivoting axis between said screen frame and the patio doorway, at least one diagonally sloping surface between mutually abutting surfaces coupled to said screen frame and coupled to the patio doorway, said diagonally sloping surface oriented to cause the screen frame to be elevated when said screen frame rotates from a more closed position to a more opened position, said more closed position occluding a greater portion of the opening in the patio doorway than said more opened position.

2. The pivoting screen door of claim 1 wherein a secondary frame is located between the patio doorway and said screen frame, said secondary frame adapted to be affixed to the patio doorway, said hinge coupled to the patio doorway through said secondary frame interposed between said hinge and the patio doorway.

3. The pivoting screen door of claim 2 wherein said secondary frame completely surrounds the opening in the patio doorway.

4. The pivoting screen door of claim 1 wherein said screen frame includes a top portion, a bottom portion and two side portions extending between said top portion and said bottom portion, said at least one hinge coupled to said screen frame through said bottom portion of said screen frame.

5. The pivoting screen door of claim 4 wherein said pivoting screen door includes a lower hinge coupled to said bottom portion of said screen frame and an upper hinge coupled to said top portion of said screen frame, said lower hinge and said upper hinge both coaxially aligned with a common substantially vertical pivoting axis for said pivoting screen door.

6. The pivoting screen door of claim 5 wherein said bias of said pivoting screen door is located adjacent one of said hinges.

7. The pivoting screen door of claim 6 wherein said closed position of said door is a position of maximum occlusion of the opening in the patio doorway by said door.

8. The pivoting screen door of claim 6 wherein said lower hinge includes an upwardly extending knuckle coupled to the patio doorway, said knuckle having a non-circular horizontal cross-section; and wherein said lower hinge includes a recess coupled said lower portion of said screen frame, said recess open in a downwardly facing direction and positioned adjacent said knuckle, said recess having a non-circular cross-section, said recess sized and shaped to allow said knuckle to extend further into said recess when said door is in said closed position than when said door is in said open position, and said knuckle and said recess sized and shaped to allow a progressively greater amount of said knuckle to be received within said recess as said door pivots away from said open position and toward said closed position, such that portions of said knuckle and portions of said recess coact under gravitational forces acting downward on the screen frame to encourage the screen frame to rotate toward said closed position.

9. The pivoting screen door of claim 6 wherein said bias includes a wing on a portion of said lower hinge attached to said screen frame, said wing extending laterally away from said pivoting axis; and wherein said bias includes a slope underlying said wing, said wing resting upon said slope, said slope having a position of maximum height located such that said wing has a maximum height when said screen frame of said door is located closer to said open position than to said closed position, said wing adapted to slide down said slope under gravitational forces, said wing causing pivoting of said door about said pivoting axis and toward said closed position as said wing slides down said slope.

10. The pivoting screen door of claim 9 wherein said lower hinge includes an upwardly extending knuckle coupled to the patio doorway, said knuckle having a non-circular horizontal cross-section; and wherein said lower hinge includes a recess coupled said lower portion of said screen frame, said recess open in a downwardly facing direction and positioned adjacent said knuckle, said recess having a non-circular cross-section, said recess sized and shaped to allow said knuckle to extend further into said recess when said door is in said closed position than when said door is in said open position, and said knuckle and said recess sized and shaped to allow a progressively greater amount of said knuckle to be received within said recess as said door pivots away from said open position and toward said closed position, such that portions of said knuckle and portions of said recess coact under gravitational forces acting downward on the screen frame to encourage the screen frame to rotate toward said closed position.

11. The pivoting screen door of claim 10 wherein said upper hinge includes a compression spring interposed between said top portion of said screen frame and the frame of the patio doorway, such that said compression spring pushes down on said screen frame and downward forces acting on said screen frame include said compression spring and gravitational forces together, such that said bias of said door toward locating said door in said closed position is enhanced compared to mere gravitationally induced bias forces alone.

12. The pivoting screen door of claim 1 wherein said door has at least two open positions on opposite sides of said closed position, such that said door can swing in and out through said opening.

13.The pivoting screen door of claim 12 wherein two substantially identical pivoting screen doors are oriented as a pair together substantially completely occluding the opening, each said door pivoting about one of two separate pivoting axes, said two pivoting axes oriented parallel to each other, said closed position defined by said two doors oriented in a common plane and in a position of maximum occlusion of the opening.

14. The pivoting screen door of claim 13 wherein a secondary frame is provided between the patio doorway and said two pivoting screen doors with each said pivoting screen door located within said secondary frame and pivotably attached to said secondary frame.

15. The pivoting screen door of claim 1 wherein said at least one hinge is adapted to cause said screen frame to be elevated when said screen frame of said door moves away from said closed position and toward said open position, and said hinge is adapted to be lowered when said screen frame of said door is rotated from said open position towards said closed position.

16. A pivoting screen door receivable within a patio doorway to selectively occlude a patio doorway opening that is formed by retracting the sliding patio door within the patio doorway, the pivoting screen door comprising in combination:

a secondary frame, said secondary frame adapted to be affixed to the doorway in a position completely surrounding the opening;

a screen frame;

a screen panel at least partially bordered by said screen frame; and at least one hinge coupled to said screen frame and said secondary frame, such that said hinge pivotably couples said screen frame and said screen panel to said secondary frame and said patio doorway.

17. The screen door of claim 16 wherein said door has a bias toward locating said screen frame in a closed position spaced from an open position, said closed position at least partially occluding the opening, said closed position occluding a greater portion of the opening than said open position.

18. The screen door of claim 17 wherein said screen frame includes a stop position at least as close to said open position as to said closed position, said bias sufficiently neutralized when said door is located at said stop position to allow said screen frame to remain detained in said stop position.

19. The screen door of claim 17 wherein said bias includes a diagonally sloping surface supporting at least a portion of a weight of said screen frame and said screen panel upon said secondary frame, said sloping surface oriented to apply a rotational force on said screen frame tending to cause said screen frame to rotate about a pivoting axis of said hinge toward said closed position.

20. The screen door of claim 19 wherein said slope is affixed to said secondary frame and a wing affixed to said screen frame slides upon said slope, said wing reaching a lower portion of said slope when said screen frame is in said closed position, said wing reaching an upper portion of said slope when said screen frame is in said open position.

21. The screen door of claim 20 wherein said wing includes a downwardly facing notch and said sloping surface includes a crest at an upper portion thereof, said peak of said slope residing within said notch when said screen frame is located in said stop position, said notch holding said screen frame without rotation in said open position, such that said screen door remains open when in said stop position and is biased toward moving from said open position to said closed position when out of said stop position and spaced away from said closed position.

22. The screen door of claim 21 wherein said hinge allows said screen frame to translate vertically while said screen frame rotates about a pivoting axis of said hinge, and wherein said wing causes said screen frame to be elevated when said wing rides up said slope and causes said screen frame to be lowered when said wing rides down said slope.

23. A pivoting screen door receivable within a patio doorway in a manner selectively occluding an opening of the doorway, the pivoting screen door comprising in combination:

a screen frame;

a screen panel at least partially bordered by said screen frame;

means to pivotably attach said screen frame to the patio doorway;

means to bias said door toward a closed position spaced from an open position, said closed position at least partially occluding the opening, said closed position occluding a greater portion of the opening than said open position;

means to detain said door in an at least partially open position said detaining means sufficiently neutralizing said biasing means to allow said door to remain in said at least partially open position; and wherein said screen door further includes a means to elevate said door when said door moves away from said closed position and toward said open position.

24. The screen door of claim 23 wherein said detaining means is oriented to detain said door when said door is in said open position.

25. The screen door of claim 24 wherein said biasing means includes a diagonally sloping surface supporting at least a portion of a weight of said screen frame and said screen panel, said sloping surface oriented to apply a rotational force on said screen frame tending to cause said screen frame to rotate about a pivoting axis of said hinge toward said closed position; and a wing affixed to said screen frame and adapted to slide upon said slope, said wing reaching, a lower portion of said slope when said screen frame is in said closed position, said wing reaching an upper portion of said slope when said screen frame is in said open position.

26. The screen door of claim 25 wherein said detaining means includes said wing having a downwardly facing notch and said sloping surface having a crest at an upper portion thereof, said crest of said slope adapted to reside within said notch when said screen frame is located in said at least partially open position, said notch holding said screen frame without rotation in said at least partially open position, such that said screen door remains open when in said at least partially open position and is biased toward moving from said open position, to said closed position when out of said at least partially open position and spaced away from said closed position.

27. The screen door of claim 23 wherein said screen door elevation means includes a diagonally sloping surface supporting at least a portion of a weight of said screen frame and said screen panel, said sloping surface oriented to apply a rotational force on said screen frame tending to cause said screen frame to rotate about a pivoting axis of said hinge toward said closed position; and a wing affixed to said screen frame and adapted to slide upon said slope, said wing reaching a lower portion of said slope when said screen frame is in said closed position, said wing reaching an upper portion of said slope when said screen frame is in said open position.

28. A pivoting screen door receivable within a patio doorway in a manner selectively occluding an opening in the doorway, the screen door comprising in combination:

a screen frame;

a screen panel at least partially bordered by said screen frame;

at least one hinge coupled to said screen frame and the patio doorway; and said hinge oriented adjacent a pivoting axis between said screen frame and the patio doorway, at least one diagonally sloping surface between mutually abutting surfaces coupled to said screen frame and coupled to the patio doorway, said diagonally sloping surface oriented to cause the screen frame to be elevated when said screen frame rotates from a more closed position to a more opened position, said more closed position occluding a greater portion of the opening in the patio doorway than said more open position.

29. The pivoting screen door of claim 28 wherein said sloping surface is coupled to a secondary frame completely surrounding the opening and affixed to the patio doorway; and wherein a wing is affixed to said screen frame, said wing abutting said sloping surface, said wing causing said screen frame to be elevated when said wing rides up said sloping surface, said wing causing said screen frame to be lowered when said wing rides down said sloping surface.

30. The pivoting screen door of claim 29 wherein said wing includes a notch thereon and said slope includes a peak at an upper edge thereof, said wing holding said screen frame in an open position when said screen frame is rotated until said wing notch is aligned with said peak of said slope, such that said screen door is automatically held in said open position.

31. The screen door of claim 28 wherein said hinge includes an upper hinge portion having a compression spring interposed between a top portion of said screen frame and the patio doorway, such that said compression spring pushes down on said screen frame and downward forces acting on said screen frame include said compression spring and gravitational forces together, such that a bias of said door toward locating said door in said closed position is enhanced compared to mere gravitationally induced bias forces alone;

wherein said door has at least two open positions on opposite sides of said closed position, such that said door can swing in and out through said opening;

wherein two substantially identical pivoting screen doors are oriented as a pair together substantially completely occluding the opening, each said door pivoting about one of two separate pivoting axes, said two pivoting axes oriented parallel to each other, said closed position defined by said two doors oriented in a common plane and in a position of maximum occlusion of the opening; and wherein a secondary frame is provided between the patio doorway and said two pivoting screen doors with each said pivoting screen door located within said secondary frame and pivotably attached to said secondary frame.

32. A pivoting screen door receivable within a patio doorway in a manner selectively occluding an opening of the doorway, the pivoting screen door comprising in combination:

a screen frame;

a screen panel at least partially bordered by said screen frame;

means to pivotably attach said screen frame to the patio doorway; and wherein said screen door further includes a means to elevate said door when said door moves away from said closed position and toward said open position.

33. The door of claim 32 including a means to bias said door toward a closed position spaced from an open position, said closed position at least partially occluding the opening, said closed position occluding a greater portion of the opening than said open position.

34. The door of claim 33 including a means to detain said door in an at least partially open position said detaining means sufficiently neutralizing said biasing means to allow said door to remain in said at least partially open position.

35. The screen door of claim 16 wherein said secondary frame forms a complete circuit around said screen frame.

* * * * *